US007164343B2

(12) United States Patent
Kessler et al.

(10) Patent No.: US 7,164,343 B2
(45) Date of Patent: Jan. 16, 2007

(54) DIGITAL POTENTIOMETER

(75) Inventors: Gary Kessler, Albuquerque, NM (US); Michael Garcia, Albuquerque, NM (US); Albert Migliori, Sante Fe, NM (US)

(73) Assignee: Avistar, Inc., Albuquerque (MX)

( * ) Notice: Subject to any disclaimer, the term of this patent is extended or adjusted under 35 U.S.C. 154(b) by 217 days.

(21) Appl. No.: 10/989,436

(22) Filed: Nov. 17, 2004

(65) Prior Publication Data

US 2006/0103500 A1 May 18, 2006

(51) Int. Cl.
*H01C 10/00* (2006.01)

(52) U.S. Cl. ..... 338/195; 338/47

(58) Field of Classification Search ..... 338/195, 338/202, 47, 49, 120; 703/3; 708/1; 341/146, 341/153; 374/168, 170, 183; 307/43, 52
See application file for complete search history.

(56) References Cited

U.S. PATENT DOCUMENTS 3,808,409 A * 4/1974 Enns et al. ..... 703/3
3,897,685 A * 8/1975 Beguin et al. ..... 374/168
4,849,903 A 7/1989 Fletcher et al.
5,218,225 A 6/1993 Zanders
5,243,535 A 9/1993 Bolan et al.
5,297,056 A 3/1994 Lee et al.
5,519,396 A * 5/1996 Distinti ..... 341/153

* cited by examiner

*Primary Examiner*—Tu Hoang
(74) *Attorney, Agent, or Firm*—Snider & Associates; Ronald R. Snider

(57) ABSTRACT

A variable potentiometer with a wiper terminal and first and second terminals has relay switches for shorting or for unshorting resistors. When resistance is reduced between the wiper and one of said terminals, resistance is increased between the wiper and another terminal. In one embodiment two strings of resistors with the same nominal values are used between the wiper and the terminals. In another embodiment, a single string of resistors are used and are switched into either the electrical connection between the wiper and the first terminal or between the wiper and the second terminal. When resistance is lowered between the wiper and one of said first or second terminals a first resistor is replaced with a first short circuit and when resistance is increased between said wiper and another of said first and second terminals a second short circuit is replaced with the first resistor.

27 Claims, 5 Drawing Sheets

DIGITAL POTENTIOMETER

TECHNICAL FIELD OF THE INVENTION

This invention relates to potentiometer circuits of the type where there is a wiper and first and second terminals at each end of a resistance between the terminals. In early potentiometers, the resistance may have been wire wound or a resistance pad. In these devices a wiper moved along the resistor and picked off the voltage from the resistor. These devices find application in high current applications. As a practical matter, impedance at the wiper would be high which would prevent current drain at the wiper. In these prior art devices, the wiper is physically moved by an operator.

PRIOR ART

Prior art devices generally utilize a resistor chain with taps between each pair of resistors. U.S. Pat. No. 4,849,903 to Fletcher and Ross is hereby incorporated by reference and teaches a digitally controlled variable resistor for effecting and presenting a selected electrical resistance. Resistance may be changed along a string of resistors by shorting out the particular resistor with a field effect device. However, such devices, since they are dependent upon field effect devices for shorting the resistor, are necessarily not useful in alternating current applications. In the U.S. Pat. No. 4,849,903, across each resistor (24*a*–24L) is a series of field effect device (54*a*–54L). When a device, such as (54*a*) is turned on, a resistor (24*a*) is effectively short circuited or removed from the series group of resistors or string of resistors. The resistors (24*a*–24L) are chosen in accordance with Table 2 and increase in value in accordance with an expression $2^{N-1}$(R) where R is equal to a selected electrical resistance. With this scheme, shorting out any combination of resistors (24*a*–24L) allows for selection of different values of resistance in increments of 1 ohm to 4095 ohms. However, the '903 patent includes a resistance (24*a*) of a value of 1 ohm and another resistance of 2048 ohms on resistor (24L). This means that very close tolerances are required for all resistors in order for changes in total resistance to be accurate. If the tolerance of a large resistor has a value greater than the smallest resister, value and resistance may decrease when an increase is intended.

U.S. Pat. No. 4,849,903 in FIG. 1 shows a control scheme for switching on and off optoisolators (36*a*) each of which include an LED (38) and anode (40). When any combination of lines to the optoisolators change state, the value of the resistance between terminal (57) and terminal (60) will change to a selected value. One or more lines from the computer may be selected in order to select a particular resistance value. In this disclosure, there is disclosed both a digital computer (17) for selecting the lines (19*a*–19L) to resistors (24*a*–24L) as well as an analog to digital converter (18). The control system of the U.S. Pat. No. 4,849,903 may be used with Applicant's invention to change the state of relays which control shorting of resistors. This control can be used to select a single relay, a double pole double throw or a four pole double throw relay in accordance with embodiments of applicant's invention.

Potentiometer circuits which digitally controlled taps or connections between pairs of resistors in a string of resistors are known in the art. U.S. Pat. Nos. 5,297,056 and 5,243,535 owned by Dallas Semiconductor are examples of this type of digital potentiometer, and are incorporated here in by reference. These devices use strings of resistors which are identical in value and have a "wiper" which is a plurality of switchable taps located between each pair of resistors. Each of these patents shows a digital potentiometer which has a plurality of resistors and at the low end of the potentiometer the "wiper" may be connected to a "LO" terminal directly.

In both the '056 and '535 patents, a wiper contact is provided where a contact point is selected between any two resistors in a string as shown in FIG. 8. These patents never connect more than one wiper contact in a passive resistor string. Therefore, there is no ability to short circuit any resistor in the string and therefore the resistance from the "LO" to the "HI" terminals never changes.

The potentiometer of both '056 and '535 maintains a constant value between the low terminal and the high terminal. There is no capability of changing the overall value of the string of resistors. The wiper is merely moved from string tap point to string tap point to select different resistances between the wiper and the low and high terminals. As disclosed, each resistor in a string of 256 resistors has the same value. This approach is analogous to a simple linear wire wound potentiometer, except that it selects taps with FET devices which are selected by a computer instead of a mechanical contact manipulated by hand.

SUMMARY OF THE INVENTION

This invention utilizes switches (preferably mechanical relays) which are controlled in any combination of on-off states by a computer. The switches are generally in the form of relays because the invention is not dependent upon field effect transistors. FET devices as taught by the prior art cannot respond to alternating currents or reverse currents.

In accordance with this invention, applicant uses a software controllable (digital computer) switching apparatus to short out or remove shorts from electrical connections between the wiper and first and second terminals of a potentiometer. The switches are relays, not semiconductor devices such as FET's. Programming as taught by U.S. Pat. No. 4,849,903 may be used to select relays in accordance with this invention. FET's will not work with this potentiometer because they conduct in only one direction and therefore cannot respond to alternating current measurements or alternating current control. Still further, FET based devices are necessarily connected so that the polarity is correct.

In this invention, a string of resistors having preferably different values are used with a programmable interface controller (PIC) chip having a customized code to implement the digitally controlled potentiometer. The switches are relays which may be individual relays, double pole double throw relays or double pole four throw relays. This potentiometer is configurable as a single potentiometer, or in a pair with master/slave capabilities for a Wheatstone bridge, stereo audio and other applications where a pair of potentiometers are required.

This potentiometer solves several problems associated with existing potentiometers when used in conjunction with an AC source. The first problem is resistance precision and drift associated with mechanical analog potentiometers. This potentiometer allows for precise setting of resistance especially in the embodiment which can connect the same resistor between the wiper and either terminal. A second problem with prior art devices is inability to handle zero-referenced AC signals as with semiconductor MOSFET potentiometers. This invention is resistor-based, producing no effects that interfere with AC wave forms applied to the device. A third problem is that high-current applications have only been controlled by mechanical analog potentiometers. Existing MOSFET potentiometers will fail when currents exceed 200 mA.

The present invention which provides a variable potentiometer which uses the different resistors between the wiper and the first and second terminals which comprises in combination: a wiper terminal; a first terminal electrically connected to said wiper terminal by a first group of resistors; a second terminal electrically connected to said wiper terminal by a second group of resistors; a plurality of switches for changing resistance between said wiper terminal and each of said first terminal and second terminal; wherein resistance is changed between said wiper and said first terminal by placing a short circuit across one or more of said first group of resistors or by removing a short circuit from across one or more of said second group of resistors; wherein resistance is changed between said wiper and said second terminal by placing a short circuit across one or more of said second group of resistors or by removing a short circuit from across one or more of said second group of resistors; and wherein resistors of said first group and resistors of said second group have values which correspond to each other.

The present invention which provides a variable potentiometer which uses the different resistors between the wiper and the first and second terminals wherein the switches comprise relays which replace resistors with short circuits and replace short circuits with resistors. The relays may comprise double pole double throw relays. A computer is used for controlling the plurality of relay switches. The computer may have a display which provides for a rotating pointer within a circle which is controlled by a mouse. The first and second resistor sets are made with resistors having the same standard value and tolerances.

The present invention which provides a variable potentiometer which uses the different resistors between the wiper and the first and second terminals wherein the first and second resistors are resistors having a tolerance value of which is determined so that where the smallest resistor value is R1 and the largest resistor is Rn, then:

$$Rn\times(\text{TOLERANCE})<R1$$

The present invention provides a variable potentiometer which uses the same resistors between the wiper and the first and second terminals which comprises in combination: a wiper terminal; a first terminal electrically connected to said wiper terminal; a second terminal electrically connected to said wiper terminal; a plurality of switches for changing resistance between said wiper terminal and each of said first and second terminals; wherein when resistance is reduced between said wiper and one of said first or second terminals a first resistor is replaced with a first short circuit; and wherein when resistance is increased between said wiper and another of said first and second terminals a second short circuit is replaced with the first resistor.

The present invention provides a variable potentiometer which uses the same resistors between the wiper and the first and second terminals which comprises in combination: a set of resistors; a wiper terminal; a first terminal electrically connected to said wiper terminal; a second terminal electrically connected to said wiper terminal; a plurality of switches for changing resistance between said wiper terminal and each of said first and second terminals; wherein when resistance is reduced between said wiper and one of said first or second terminals a subset of said resistors is replaced with first short circuits; and wherein when resistance is increased between said wiper and another of said first and second terminals second short circuits are replaced with the subset of resistors.

The present invention may use switches which comprise relays which replace the first resistor with a short circuit and replace a short circuit with the first resistor. The present invention may use single pole single throw, double pole double throw or four pole double pole relays.

The present invention may change resistance between the wiper and one of said first and second terminals in the case where the same resistor is used between the wiper and the first or second terminals wherein: a first subset of double pole double throw relays electrically remove the subset of resistors from the electrical connection between one of said first and second terminals; a second subset of double pole double throw relay insert a subset of shorting connections in the electrical connection between the one of said first and second terminals; the first subset of double pole double throw double throw relays electrically insert the subset of resistors between the other of said first and second terminals; and the second subset of double pole double throw relays remove a subset of short connections between the other of said first and second terminals.

The present invention may change resistance in a variable potentiometer which uses the same resistors between the wiper and the first and second terminals wherein when resistance is changed between said wiper and one of said first and second terminals: a subset of first double pole double throw relays which electrically remove a resistor subset from the electrical connection between one of said first and second terminals and replace the resistor subset with a subset of shorts; a subset of second double pole double throw relays which electrically insert the resistor subset and remove a subset of shorts in the electrical connection between the other one of said first and second terminals.

In the present invention when resistance is reduced between the wiper and a terminal and when resistance is increased between the wiper and another terminal, a subset of the plurality of resistors are replaced with first short circuits and a corresponding subset of second short circuits are replaced with the subset of resistors.

In the present invention, the resistors in the set of resistors have a tolerance value of which is determined so that where a smallest resistor value is R1 and a largest resistor value is Rn, then:

$$Rn\times(\text{TOLERANCE})<R1$$

In the present invention, the sum of the set of resistor values is constant and the total resistance between said first and second terminals always constant.

DETAILED DESCRIPTION

Figure 1:
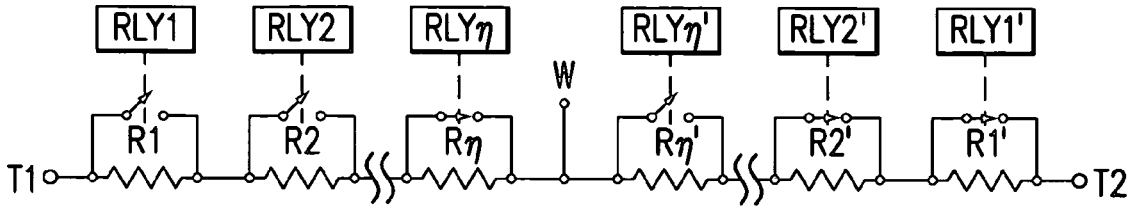
FIG. 1 shows conceptually a potentiometer in accordance with Applicant's invention where pairs of resistors are used between a fixed wiper and terminals T1 and T2. Each pair of resistors has the same value.

The invention may use a serial port to precisely set resistance values using a defined control sequence sent to the potentiometer device over a serial port. Actual switching of resistor shorts or resistor position from one side of a wiper to another can be easily implemented by relays controlled by the computerized sequence. This device when fully implemented may display the requested resistance on a computer screen or a display device incorporated into a test instrument. The potentiometer can be paired with a "slave" potentiometer to create a Wheatstone bridge circuit that works using either AC or DC signals.

The potentiometer of this invention which utilizes resistors and relays will have electrical characteristics exactly like a standard analog potentiometer in that there is no need to consider the polarity or absolute sign of the signal applied. In this invention, the speed at which the resistance can be changed is limited by the speed of the micro-mechanical relays. The frequency response is limited by stray capacitance and is generally above 1 Mhz. Ordinary relay response times exceed the response time for hydraulic systems.

This invention allows for easy software implemented minimum increment changes or software implemented major changes without passing through intermediate values (software-selectable resistance values), constant input impedance, current limits are set by resistor ratings, two board designs (master and slave), and maintenance of last resistance value in non-volatile memory (last relay state).

In the case where separate resistors are used between the wiper and a first terminal and the wiper and a second terminal, the digital potentiometer is constructed from a pair of resistor sets and a set of electromechanical relays. There may be two circuits (master and slave) which share a serial port input which provides control information (from the computer) regarding how the circuit(s) should behave electrically. Each circuit "listens" to the serial port for control information that determines which circuit is enabled, and which resistance value that circuit should select. If a circuit is enabled, the PIC chip on the circuit board determines the requested resistance from the control information. The software in the PIC chip then looks up the configuration of relays that should be opened or closed so that the resister series output resistance is the value requested by the computer which effectively creates a "wiper" as used in analog potentiometers. The "wiper" of the potentiometer is "moved" by changing the state of relays (pairs of single pole single throw) or the state of a double pole double throw relay. The circuit operates electrically like a conventional potentiometer in all important characteristics, including fixed resistance across the potentiometer (within tolerance limits). The number of resistors in the string, and the number of strings, is determined by the overall resolution required, i.e., 1 k, 10 k, 100 k.

Where the present invention provides a variable potentiometer which uses the same resistors between the wiper and the first and second terminals an electromechanical relay removes a resistor and replaces it with short circuit between the wiper and a first terminal and removes a short circuit and replaces it with the resistor between the wiper and a second terminal. Single pole single throw, double pole double throw or four pole double pole relays may be used. This configuration avoids tolerance problems which are unavoidable where different resistors are used between the wiper and different terminals. Otherwise, this embodiment is controlled like the case where separate resistors are used between the wiper and a first terminal and the wiper and a second terminal.

FIG. 1 shows conceptually the switches associated with resistors R1, R2, Rn, Rn', R2' and R1'. Where R1 is in the circuit to the side of terminal T1, R1' to the side of the terminal T2' is short circuited, thereby removing R1' from the T2 side of the wiper W. In a similar manner, whenever any designated resistor is short circuited on one side of the wiper, its corresponding resistor is in circuit or is no longer short circuited on the other side of the wiper. As shown in FIG. 1, relays Rly1, Rly2 . . . Rly1', Rly2'. . . are single pole single throw relays which may be controlled by a computer. The only necessary condition is that when a relay such as Rly1 is closed, that Rly1' must be open. In this manner, if resistors R1=R1', R2=R2', and Rn=Rn', then the resistance from terminal T1 to terminal T2 will always remain constant.

Figure 2:
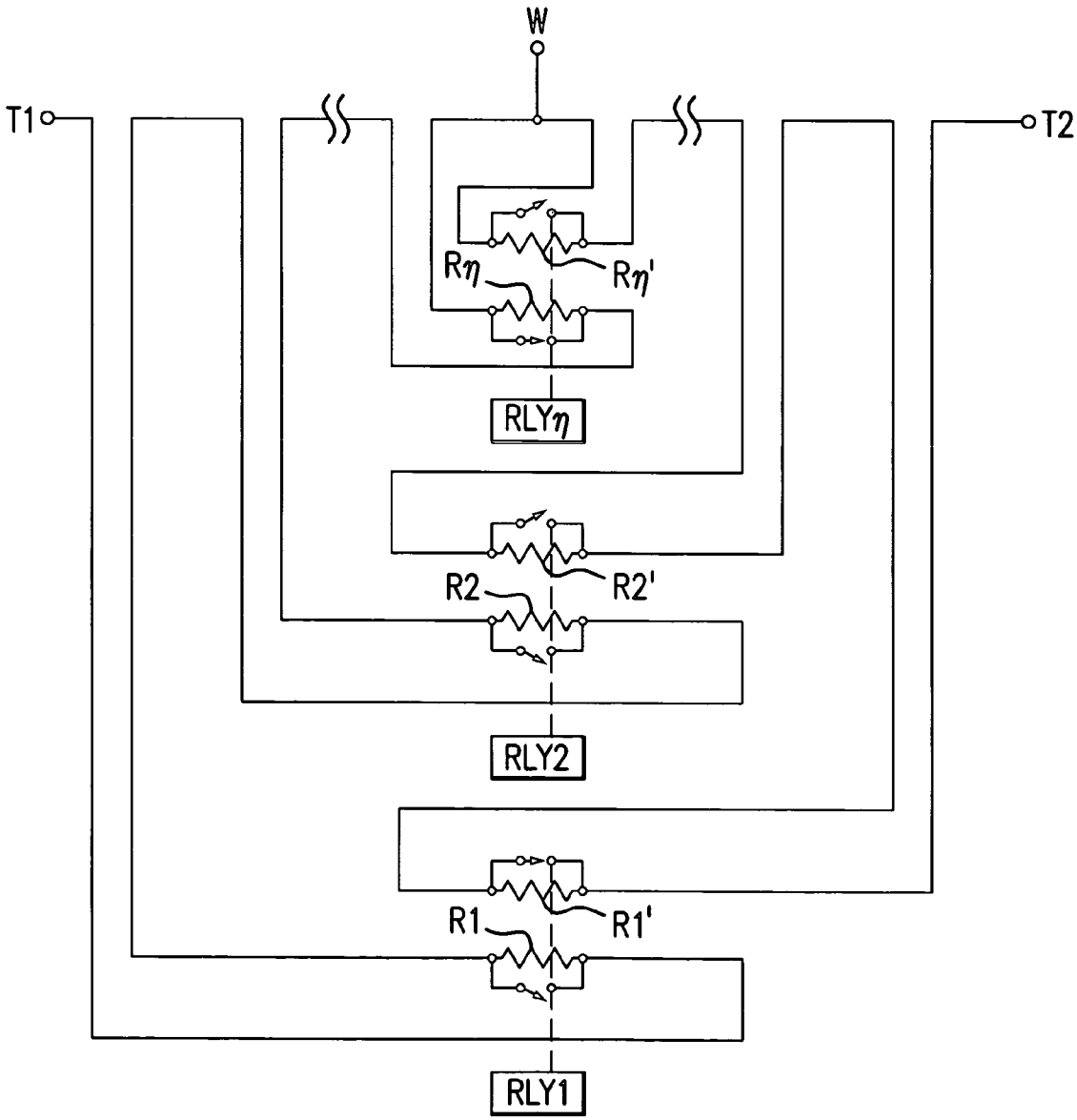
FIG. 2 shows an implementation of the device of FIG. 1 where switches for pairs of resistors are controlled by double-pole-double-throw relays.

FIG. 2 is a double-pole-double-throw relay embodiment of the device shown in FIG. 1. As shown in FIG. 2, relay Rlyn short circuits resistor Rn and opens a short across resistor Rn', thereby inserting resistor Rn' between W and T2. On the other hand, relay RLY1 short circuits resistor R1' and opens a short across resistor R1, thereby inserting R1 into the connection between W and T1.

However, as a practical matter, resistors necessarily have tolerance limitations. For instance, all resistors should have close tolerances, otherwise if resistors having large values also have large tolerances, the shorting out of resistor Rn on the T1 terminal side of the potentiometer of FIG. 1 and removing the short from Rn' in the T2 terminal side of the potentiometer of FIG. 1 will result in a variance which is greater than the total amount of a low value resistor such as R1 and R1'.

Resistors R1, R2, . . . Rn may vary in accordance with the following formula:

$$Rn=R1\ (2^{n-1})$$

If resistors in the string on the T1 side of the wiper and the T2 side of the wiper of FIG. 1 are exactly equal in value (no tolerance variation), then substitution of R1' for R1 between T1 and T2 will cause no variance in the overall resistance of the wiper W. Considering the resistance between the wiper W and T2, this resistance may be changed by any combination of the number of resistors R1', R2' . . . Rn'.

Figure 5A:
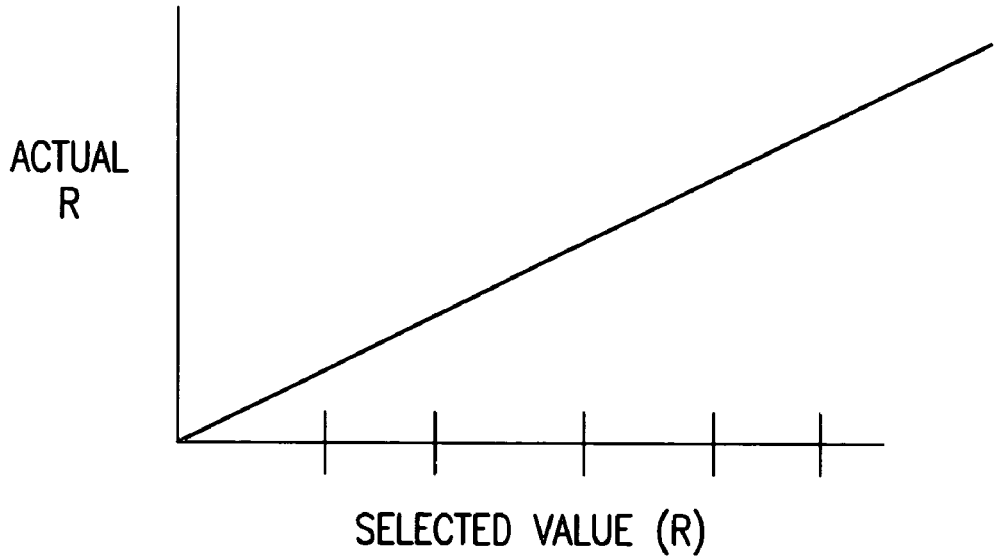
In FIG. 5*a* there is shown a linear monotonic relationship between a selected resistance value and an actual value. Monotonic defines the relationship as always increasing in value.
Figure 5B:
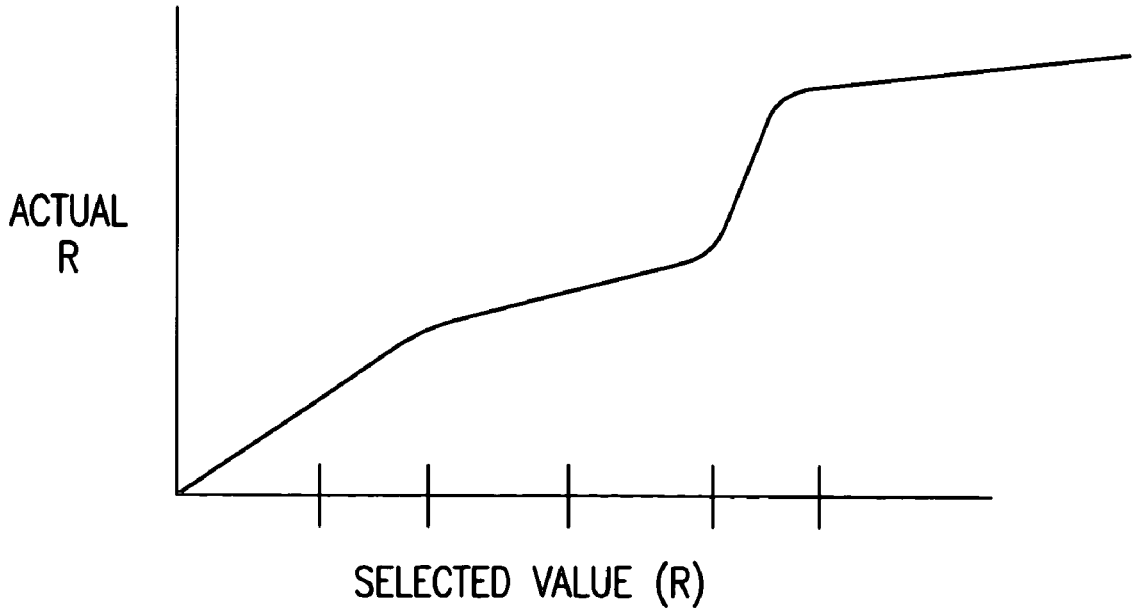
In FIG. 5*b* there is shown a non-linear monotonic relationship between a selected resistance value and an actual value. Monotonic defines the relationship as always increasing in value, but since it is non-linear the slope of the line while always positive can change.
Figure 6:
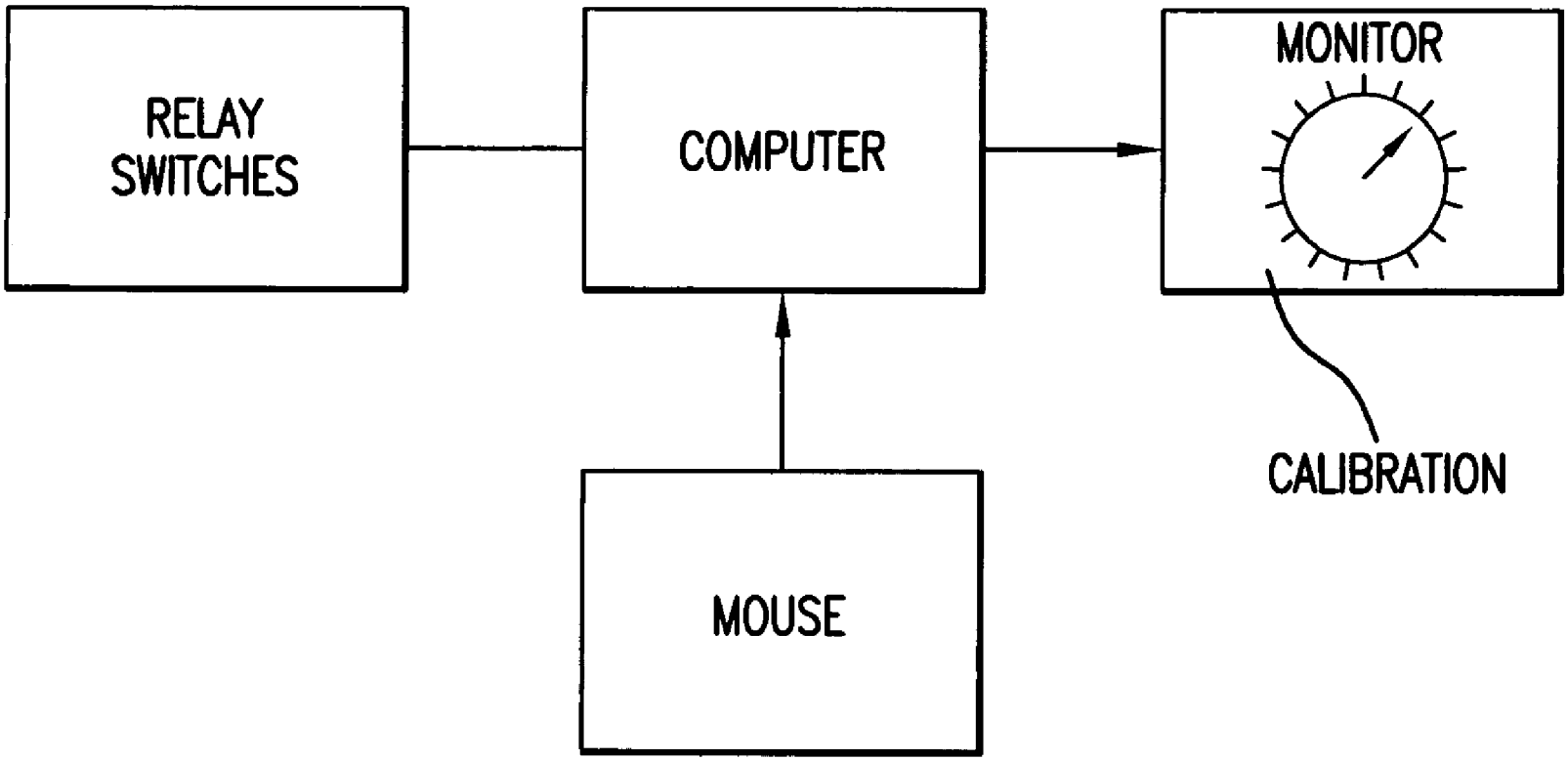
In FIG. 6 there is shown a block diagram of a computer which provides control for relay switches. The computer is controlled by a mouse. The monitor shows a circular display which is calibrated in accordance with resistance between the wiper and a terminal.

If the resistor values and the resistors value selected are perfect (no tolerance variation), an increase in selected value (R) will produce an actual increase in resistance which is directly proportional to the selected value as shown in FIG. 5*a*. This relationship shown in FIG. 5*a* is generally referred to as a linear relationship. In such a linear relationship, as a value is selected, the actual value always increases and at the same rate. There is also the case of a non linear relationship, but monotonic relationship which is shown in FIG. 5B. In this case, selected values of R do not result in straight line linear increases in the actual value of R, but the actual value of R never decreases as a higher selected value of R is chosen.

In the embodiment of FIG. 1 and FIG. 2 it is necessary to maintain a monotonic relationship so that it is known that when resistance is changed, in an arm, such as from W to T2, that actual resistance increases. Conversely, if resistance is decreased from W to T1, it must also follow a monotonic curve a shown in FIGS. 5*a* and 5*b*. If the tolerances in the resistors R1'–Rn' are large, then the selection of a higher value of R may actually result in a reduction of the actual R. This condition will result in erroneous measurement and monotonicity is lost due to high tolerance variations in the individual resistors.

In the embodiments shown in FIGS. 1 and 2, if R1 is the smallest resistor and the largest resistor is equal to Rn, then the relationship is monotonic if $$Rn\times(\text{TOLERANCE})<R1$$

An illustration of the problem of maintaining monotonicity (ever increasing value of R) is illustrated by considering a string of resistors which follow the relationship $$Rn=R1\ (2^{n-1})$$

If the total resistance in the string (from W to T1 on W to T2 is 1023 ohms, then the highest resistance value will be a resistor of 512 ohms. The 512 ohm resistor and the sum of all the lower value resistors will total 1023 ohms. In selecting the resistance, if the previous sum of 511 ohms is correct, and a step up to 512 ohms is taken, the 511 ohm string of resistors will all be shorted and the 512 ohm resistor will be inserted. If the 512 ohm resistor has a tolerance of 1%, it is possible that the selection will result in a resistor of the value of 512−5.12 or 506.88 ohms. This would be a reduction in the resistance value of the string and violate the monotonicity requirement as illustrated in FIGS. 5A and 5B because the actual value of R must always increase. However, as illustrated here, the value can actually decrease if tolerance is 1%. 5.12 ohms is greater than the initial 1 ohm resistor which is used in making up values of the actual resistance. The value of 513 ohms (512+1) utilizing the 1% tolerance 512 ohm resistor would result in 507.88 ohms which is still less than the value intended. Under these conditions, the operator of an instrument will be under the impression that the resistance is increasing when it is in fact decreasing. This problem can be solved by tightening the tolerance on the 512 ohm resistor to 0.1% which results in 512 ohms−0.512 ohms. Monotonicity is achieved although it is nonlinear.

Figure 3:
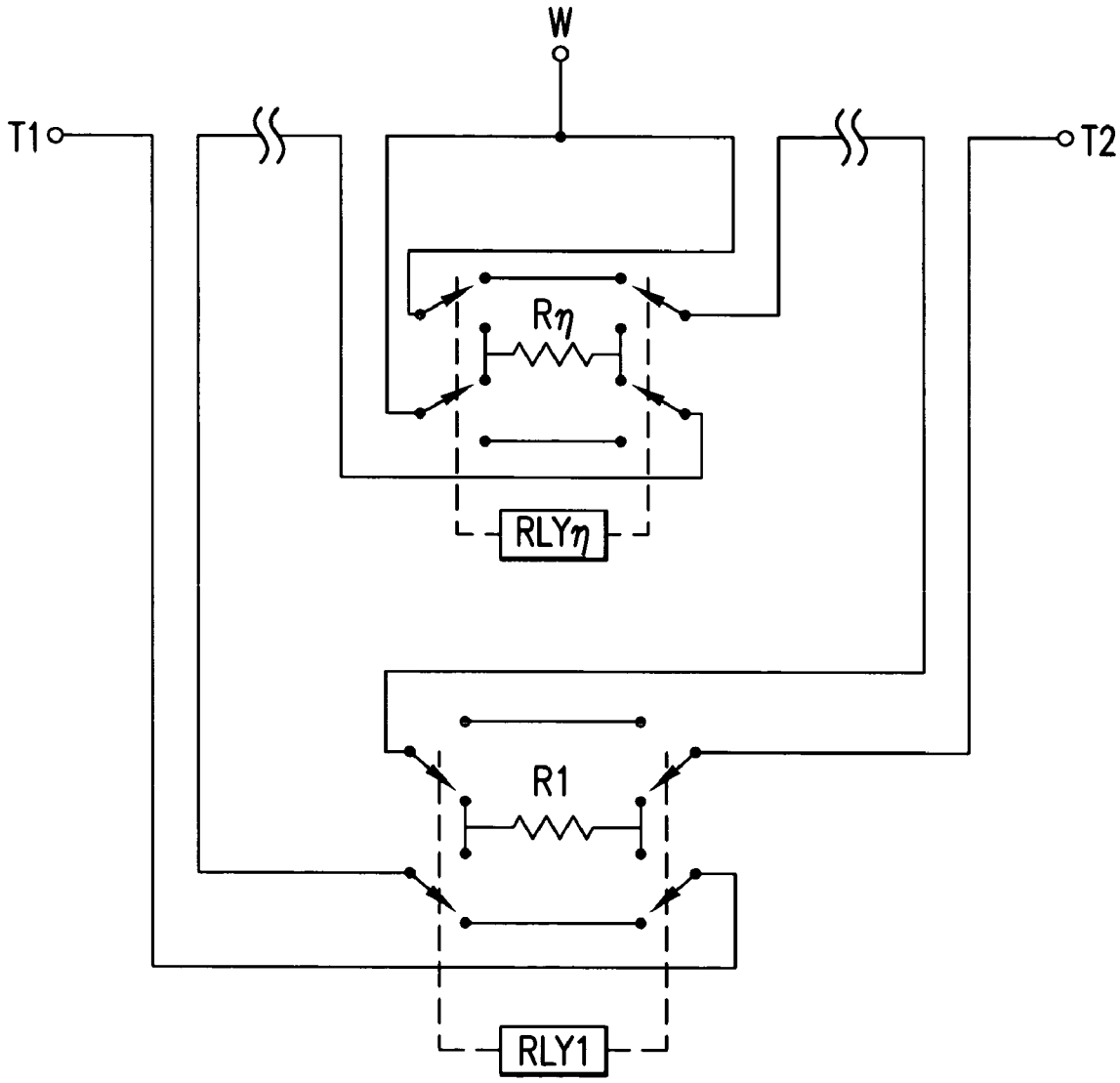
FIG. 3 shows a second embodiment of Applicant's invention where a single resistance is used on either side of the wiper terminal. In this embodiment the connections to the string are connected to the pole contacts of relays, and shorts and resistors which are moved from one side of the wiper terminal to another.
Figure 4:
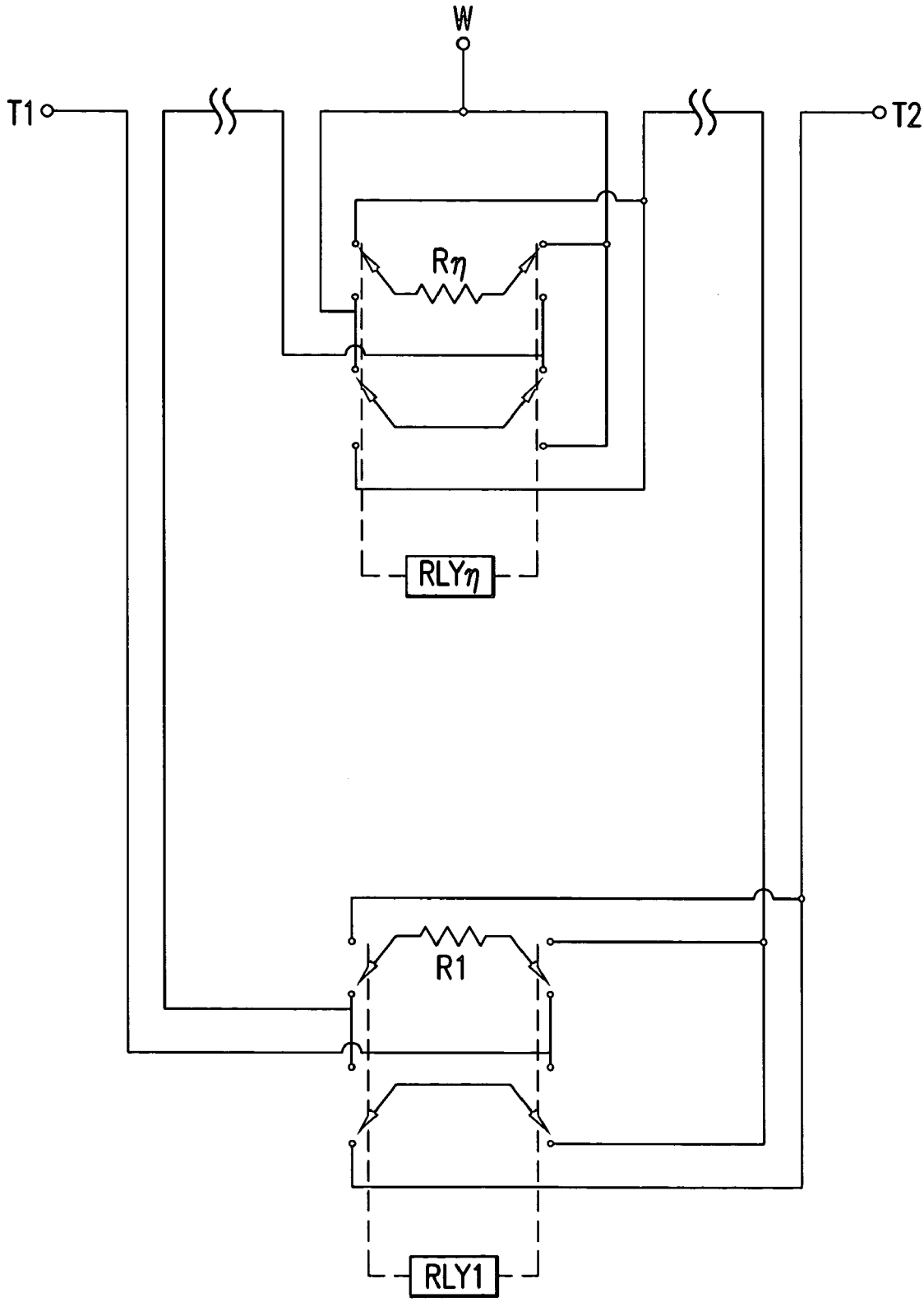
In FIG. 4, there is shown another embodiment utilizing a four pole double throw switch relay where the pole contacts are connected respectively to resistors and shorts. The throw contacts are connected to points in the wiper.

The embodiments shown in FIGS. 3 and 4 completely solve the problem of tolerance values and monotonicity as discussed above. The solution requires the use of exactly the same resistors between W and T1 and W and T2. As shown in FIG. 3, each resistor R1, R2 . . . Rn is electrically removed from the string from T1 to W and inserted into the string from W to T2 upon actuation of the associated relay. The resistor R1 of FIG. 3 is shown in the condition where R1 is inserted into the string between W and T2. By utilizing the exact same resistors, even if tolerances are loose, necessarily the resistance will always be reduced on one side and always increased on the other side of the wiper because the resistor remains the same. Therefore the embodiments shown in FIGS. 3 and 4 solve the tolerance problem and provide at least a nonlinear but monotonic relationship in all cases. If the resistance tolerances are very small in the devices of FIGS. 3 and 4, then the relationship between the selected resistor and the actual resistor will approach that of a linear relationship as shown in FIG. 5*a*.

The relays of this invention may be wired to the short circuits and to the resistors in any manner so that when the relays are closed (normally closed, no power), there is any combination of resistances between W and T1 and W and T2. As shown in FIG. 3, the resistance between W and T1 is Rn and the resistance between W and T2 is R1. By wiring the relays so that resistances are not 0 between either W and T1 and W and T2, the operator is assured that there will not be a short circuit between W and either one of the terminals upon initial startup. This has advantages in certain types of measurements and instruments. This is a hard wired solution which is implemented in accordance with this invention.

Resistance values for resistors following the relationship R=R1 ($2^{n-1}$) can be selected from standard resistance values which are commonly available. Table 1 shows a standard resistance value table which shows values which are readily obtainable.

TABLE 1

| | | | | |
|---|---|---|---|---|
| .39 | 3.90 | 39 | 390 | 3900 |
| .43 | 4.30 | 43 | 430 | 4300 |
| .47 | 4.70 | 47 | 470 | 4700 |
| .51 | 5.1 | 51 | 510 | 5100 |
| .56 | 5.6 | 56 | 560 | 5600 |
| .62 | 6.2 | 62 | 620 | 6200 |
| .68 | 6.8 | 68 | 680 | 6800 |
| .75 | 7.5 | 75 | 750 | 7500 |
| .82 | 8.2 | 82 | 820 | 8200 |
| .91 | 9.1 | 91 | 910 | 9100 |
| 1.00 | 10.0 | 100 | 1000 | 10000 |
| 1.10 | 11.0 | 110 | 1100 | 11000 |
| 1.20 | 12.0 | 120 | 1200 | 12000 |
| 1.30 | 13.0 | 130 | 1300 | 13000 |
| 1.50 | 15.0 | 150 | 1500 | 15000 |
| 1.60 | 16.0 | 160 | 1600 | 16000 |
| 1.80 | 18.0 | 180 | 1800 | 18000 |
| 2.00 | 20.0 | 200 | 2000 | 20000 |
| 2.20 | 22.0 | 220 | 2200 | 22000 |
| 2.40 | 24.0 | 240 | 2400 | 24000 |
| 2.70 | 27.0 | 270 | 2700 | 27000 |
| 3.00 | 30.0 | 300 | 3000 | 30000 |
| 3.30 | 33.0 | 330 | 3300 | 33000 |
| 3.60 | 36.0 | 360 | 3600 | 36000 |

An example of selection of resistors to yield a relationship R=R1 ($2^{n-1}$) is shown in Table 2.

TABLE 2

| 2n | Standard Resistor Values |
|---|---|
| 1 | 1 |
| 2 | 2 |
| 4 | 2 + 2 |
| 8 | 3 + 3 + 2 |
| 16 | 16 |
| 32 | 16 + 16 |
| 64 | 62 + 2 |
| 128 | 100 + 27 + 1 |
| 256 | 240 + 16 |
| 512 | 510 + 2 |

The resistance values for the embodiment of FIGS. 1 and 2, or for the embodiments of FIGS. 3 and 4 may also be selected in accordance with any criteria, such as all equal, or in arbitrary units such as combinations of 1, 5, 10, 50, 100, 500, and/or 49.5 ohms.

The invention claimed is:

1. A variable potentiometer comprising in combination:

a wiper terminal;

a first terminal electrically connected to said wiper terminal;

a second terminal electrically connected to said wiper terminal;

a plurality of switches for changing resistance between said wiper terminal and each of said first and second terminals;

wherein when resistance is reduced between said wiper and one of said first and second terminals a first resistor is replaced with a first short circuit; and wherein when resistance is increased between said wiper and another of said first and second terminals a second short circuit is replaced with the first resistor.

2. The variable potentiometer in accordance with claim 1, wherein said switches comprise relays which replace the first resistor with a short circuit and replace a short circuit with the first resistor.

3. The variable potentiometer in accordance with claim 1, wherein when resistance is changed between said wiper and one of said first and second terminals;

a first double pole double throw relay electrically removes the resistor from the electrical connection between one of said first and second terminals;

a second double pole double throw relay inserts a shorting connection in the electrical connection between the one of said first and second terminals;

the first double pole double throw relay electrically inserts the resistor between the other of said first and second terminals; and the second double pole double throw relay electrically removes a short connection between the other of said first and second terminals.

4. The variable potentiometer in accordance with claim 3, wherein a four pole double throw relay comprises the first and second double pole double throw relays.

5. The variable potentiometer in accordance with claim 1, wherein when resistance is changed between said wiper and one of said first and second terminals;

a first double pole double throw relay electrically removes the resistor from the electrical connection between one of said first and second terminals and replaces the resistor with a short;

a second double pole double throw relay electrically inserts the resistor and removes a short in the electrical connection between the other one of said first and second terminals.

6. The variable potentiometer in accordance with claim 5, wherein a four pole double pole relay comprises the first and second double pole double pole relays.

7. A variable potentiometer comprising in combination:

a set of resistors;

a wiper terminal;

a first terminal electrically connected to said wiper terminal;

a second terminal electrically connected to said wiper terminal;

a plurality of switches for changing resistance between said wiper terminal and each of said first and second terminals;

wherein when resistance is reduced between said wiper and one of said first and second terminals a subset of said resistors is replaced with first short circuits; and wherein when resistance is increased between said wiper and another of said first and second terminals second short circuits are replaced with the subset of resistors.

8. The variable potentiometer in accordance with claim 7, wherein said switches comprise relays which replace the subset of resistors with first short circuits and replace second short circuits with the subset of resistors.

9. The variable potentiometer in accordance with claim 8, wherein said relays comprise double pole double throw relays.

10. The variable potentiometer in accordance with claim 8, wherein said relays comprise four pole double throw relays.

11. The variable potentiometer in accordance with claim 7, wherein when resistance is changed between said wiper and one of said first and second terminals;

a first subset of double pole double throw relays electrically remove the subset of resistors from the electrical connection between one of said first and second terminals;

a second subset of double pole double throw relays insert a subset of shorting connections in the electrical connection between the one of said first and second terminals;

the first subset of double pole double throw double throw relays electrically inserts the subset of resistors between the other of said first and second terminals; and the second subset of double pole double throw relays remove a subset of short connections between the other of said first and second terminals.

12. The variable potentiometer in accordance with claim 11, wherein four pole double pole relays comprise the first and second subsets of double pole double pole relays.

13. The variable potentiometer in accordance with claim 7, wherein when resistance is changed between said wiper and one of said first and second terminals;

a subset of first double pole double throw relays which electrically remove a resistor subset from the electrical connection between one of said first and second terminals and replace the resistor subset with a subset of shorts;

a subset of second double pole double throw relays which electrically insert the resistor subset and remove a subset of shorts in the electrical connection between the other one of said first and second terminals.

14. The variable potentiometer in accordance with claim 13, wherein a four pole double throw relay comprises the first and second double pole double throw relays.

15. The variable potentiometer in accordance with claim 7, wherein the resistors in the set of resistors have a tolerance value of 1% or less.

16. The variable potentiometer in accordance with claim 7, wherein resistors in the set of resistors have a tolerance value of which is determined so that where a smallest resistor value is R1 and a largest resistor value is Rn, then:

$$Rn \times (\text{TOLERANCE}) < R1$$

17. The variable potentiometer in accordance with claim 7, wherein the sum of the set of resistor values is constant and the total resistance between said first and second terminals always constant.

18. The variable potentiometer in accordance with claim 7, further comprising a computer for controlling the plurality of switches.

19. The variable potentiometer in accordance with claim 7, further comprising a computer having a display which provides for a rotating pointer within a circle which is controlled by a mouse.

20. The variable potentiometer in accordance with claim 11, wherein said computer display comprises a display circle that is calibrated around its perimeter to indicate a quantity controlled.

21. The variable potentiometer in accordance with claim 8, wherein resistor subsets have a value other than zero and there are resistor subsets between said wiper and said first terminal and between said wiper and said second terminal when said relays are in their normally closed position.

22. A variable potentiometer comprising in combination:

a wiper terminal;

a first terminal electrically connected to said wiper terminal by a first group of resistors;

a second terminal electrically connected to said wiper terminal by a second group of resistors;

a plurality of switches for changing resistance between said wiper terminal and each of said first terminal and second terminal;

wherein resistance is changed between said wiper and said first terminal by placing a short circuit across one or more of said first group of resistors or by removing a short circuit from across one or more of said second first of resistors;

wherein resistance is changed between said wiper and said second terminal by placing a short circuit across one or more of said second group of resistors or by removing a short circuit from across one or more of said second group of resistors; and wherein resistors of said first group and resistors of said second group have values which correspond to each other.

23. The variable potentiometer in accordance with claim 22, further comprising a computer for controlling the plurality of switches.

24. The variable potentiometer in accordance with claim 22, wherein said switches comprise double pole/double throw relays.

25. The variable potentiometer in accordance with claim 22, wherein when a resistor in said first group is short circuited, the corresponding resistor in the second group has a short removed.

26. The variable potentiometer in accordance with claim 22, wherein when resistance is changed between said wiper and one of said first and second terminals;

a subset of double pole double throw relays electrically remove a subset of resistors from the electrical connection between the wiper and one of said first and second terminals, insert a corresponding subset of shorting connections in the electrical connection between said wiper and one of said first and second terminals, electrically insert another subset of resistors between the wiper and the other of said first and second terminals, and remove a corresponding subset of shorting connections between the wiper and the other of said first and second terminals.

27. The variable potentiometer in accordance with claim 22, wherein resistors in the first and second groups of resistors are resistors having a tolerance value which is determined so that where the smallest resistor is R1 and the largest resistor is Rn, then:

$$Rn \times (\text{TOLERANCE}) < R1$$

* * * * *